US005989070A

United States Patent [19]

Al-Turki

[11] Patent Number: 5,989,070

[45] Date of Patent: Nov. 23, 1999

[54] BULB SOCKET ADAPTER

[76] Inventor: Ali Al-Turki, Block 2,Str 24,House # 7, Al-Khaledyah, Kuwait

[21] Appl. No.: 09/027,038

[22] Filed: Feb. 20, 1998

[51] Int. Cl.[6] ..... H01R 25/00

[52] U.S. Cl. ..... 439/644; 439/638

[58] Field of Search ..... 439/638, 640, 439/643, 644

[56] References Cited

U.S. PATENT DOCUMENTS

| | | | |
|---|---|---|---|
| 420,705 | 2/1890 | Stewart | 439/644 |
| 1,172,953 | 2/1916 | Dempster . | |
| 1,640,434 | 8/1927 | Weston . | |
| 2,492,475 | 12/1949 | Granger | 439/644 |
| 4,548,449 | 10/1985 | Corsetti | 339/154 |
| 4,936,789 | 6/1990 | Ugalde . | |
| 5,320,548 | 6/1994 | Schadhauser . | |

*Primary Examiner*—Lincoln Donovan
*Attorney, Agent, or Firm*—Michael I. Kroll

[57] ABSTRACT

A light bulb-socket adapter for connecting a bayonet type light bulb to an Edison type socket or an Edison type light bulb to a bayonet type socket. The light bulb-socket adapter includes an Edison type connector section made of conductive material and a connection terminal extending therefrom and a bayonet type bulb receiving section and first and second contact terminals positioned within the receiving section for connecting a bayonet type light bulb to an Edison type socket. The light bulb-socket adapter includes a bayonet type connector section and first and second contact terminals extending from the connector section and an Edison type bulb receiving section made of conductive material and a connection terminal extending therefrom for connecting an Edison type light bulb to a bayonet type socket. Each adaptor includes a nonconductive barrier layer connected between and electrically isolating said Edison type section and bayonet type section, a first connection wire connecting the conductive material of the Edison type section to the first connection terminal of the bayonet type section and a second connection wire connecting the contact terminal of the Edison type section to the second connection terminal of the bayonet type section. When the adaptor is connected between a bulb and socket, the bulb and socket form a complete circuit via the first and second wires respectively.

2 Claims, 5 Drawing Sheets

BULB SOCKET ADAPTER

BACKGROUND OF THE INVENTION

1. Field of the Invention

The present invention relates generally to adapters for light bulbs and, more specifically, to an adapter to allow use of any type of bulb with any type of socket.

2. Description of the Prior Art

Numerous light bulb socket adapters have been provided in the prior art For example, U.S. Pat. Nos. 1,172,953; 1,640,434; 4,936,789 and 5,320,548 all are illustrative of such prior art. While these units may be suitable for the particular purpose to which they address, they would not be as suitable for the purposes of the present invention as heretofore described.

U.S. Pat. No. 1,172,953

Inventor: John T. H. Dempster

Issued: Feb. 22, 1916

This invention relates to adapters for enabling an electric lamp or the like to be operated at its rated or any desired voltage in a socket or receptacle between whose terminals some different voltage prevails. This device combines in a simple, compact, convenient, unitary structure a base or plug device or element for the aforesaid socket; a socket or receptacle for the lamp and means such as a transformer for producing the desired voltage between the terminals ir contacts of said latter socket.

U.S. Pat. No. 1,640,434

Inventor: F. H. Weston

Issued: Aug. 30, 1927

The present invention relates to holders for incandescent electric lamps and more especially to devices for adapting holders designed to receive and function with one type of lamp base to the reception and operation with lamps having a different type of base and commercially known as socket adapters. This invention provides a socket adapter whereby a lamp with an Edi-Swan type of base may be readily connected in operative relation to a standard Edison socket, which shall be strong, compact and of low manufacturing cost and which will insure accurate positioning of the lamp relative to the socket.

U.S. Pat. No. 4,936,789

Inventor: Joseph Ugalde

Issued: Jun. 26, 1990

An adapter includes a threaded portion intended to be screwed into a conventional lamp socket to replace a standard incandescent light bulb. The adapter includes spring clips that are operative to prevent removal of terminal pins on the base of a fluorescent lamp. A table lamp in which the adapter is installed is connected through a male polarized electrical plug to a remote power supply. The power supply is plugged into a conventional AC wall outlet. A tamper-proof fastener attaches the power supply to the outlet, preventing it from being removed by a user who does not have access to a special driver required to turn the fastener. Spring clips within the power supply prevent removal of the male plug, so that the table lamp cannot be stolen without cutting the power cord.

U.S. Pat. No. 5,320,548

Inventor: Klaus Schadhauser

Issued: Jun. 14, 1994

To permit use of a compact fluorescent lamp having a base with projecting terminal pins in an ordinary standard Edison light bulb socket, an adapter has a light bulb thread and the housing body includes a reception well to receive a locating plate or plug from the lamp. To relieve stresses and strains on reception terminals which are electrically connected to a printed circuit board within the adapter body, the reception terminals, and preferably the connecting lugs thereof, are formed with openings which are engaged by matching projections formed on the housing body, and preferably by projections extending from the wall defining the well which receives the locating plate or lug of the lamp. This avoids bending, and hence damage to the printed circuit board upon insertion of the lamp pins in the spring contact portions of the reception terminals since assembly stresses are accepted by the housing body and not by the printed circuit board.

SUMMARY OF THE PRESENT INVENTION

The present invention relates generally to adapters for light bulbs and, more specifically, to an adapter to allow use of any type of bulb with any type of socket.

A primary object of the present invention is to provide a light bulb-socket adapter that will overcome the shortcomings of prior art devices.

Another object of the present invention is to provide a light bulb-socket adapter which is able to adapt an Edison type light bulb to fit into a bayonet cap base.

An additional object of the present invention is to provide a light bulb-socket adapter which is able to adapt a bayonet type light bulb to fit into an Edison type cap base.

A further object of the present invention is to provide a light bulb-socket adapter able to adapt a light bulb of any size for connection to a socket of any size.

A yet further object of the present invention is to provide a light bulb-socket adapter including a separator section preventing the base of the bulb from contacting the base of the socket.

Another object of the present invention is to provide a light bulb-socket adapter that is simple and easy to use.

A still further object of the present invention is to provide a light bulb-socket adapter that is economical in cost to manufacture.

Additional objects of the present invention will appear as the description proceeds.

A light bulb-socket adapter for connecting a bayonet type light bulb to an Edison type socket or an Edison type light bulb to a bayonet type socket is described by the present invention. The light bulb-socket adapter includes an Edison type connector section made of conductive material and a connection terminal extending therefrom and a bayonet type bulb receiving section and first and second contact terminals positioned within the receiving section for connecting a bayonet type light bulb to an Edison type socket. The light bulb-socket adapter includes a bayonet type connector section and first and second contact terminals extending from the connector section and an Edison type bulb receiving section made of conductive material and a connection terminal extending therefrom for connecting an Edison type light bulb to a bayonet type socket. Each adaptor includes a nonconductive barrier layer connected between and electrically isolating said Edison type section and bayonet type section, a first connection wire connecting the conductive material of the Edison type section to the first connection terminal of the bayonet type section and a second connection wire connecting the contact terminal of the Edison type section to the second connection terminal of the bayonet type section. When the adaptor is connected between a bulb and socket, the bulb and socket form a complete circuit via the first and second wires respectively.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
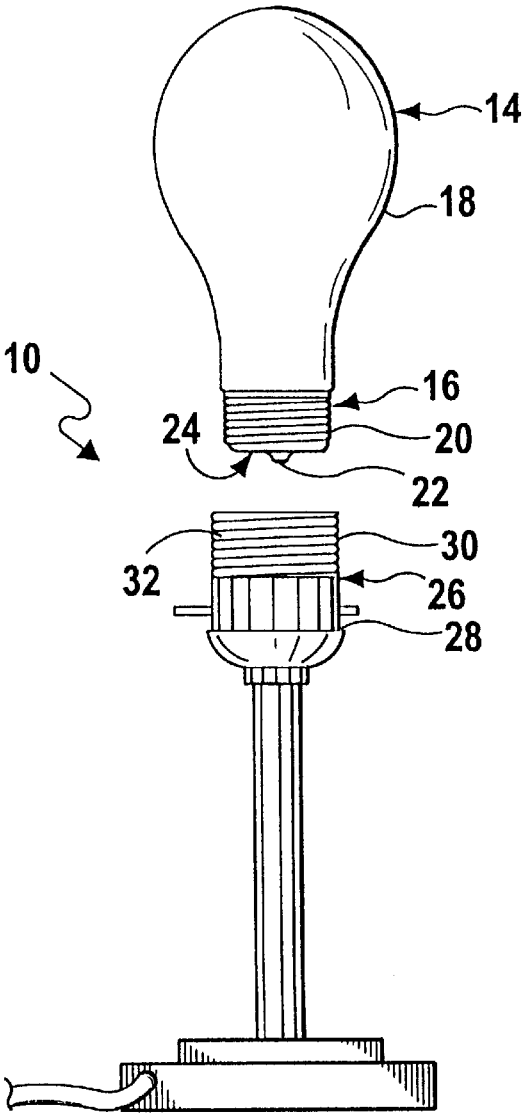
FIG 1 (PRIOR ART)
FIG. 1 is a front elevational expanded view of a typical Edison type lamp and light bulb.

Turning now descriptively to the drawings, in which similar reference characters denote similar elements throughout the several views, the Figures illustrate the light bulb-socket adapter of the present invention. With regard to the reference numerals used, the following numbering is used throughout the various drawing figures.

10 Edison type bulb and socket arrangement
12 bayonet type bulb and socket arrangement
14 Edison type light bulb
16 base portion of Edison type light bulb
18 bulb portion of Edison type light bulb
20 thread spiraling around base portion of Edison type light bulb
22 contact on Edison type light bulb
24 underside of Edison type light bulb -continued 26 Edison type socket
28 base of Edison type socket
30 skirt extending from base of Edison type socket
32 thread spiraling around skirt of Edison type socket
34 bayonet type light bulb
36 base portion of bayonet type light bulb
38 bulb portion of bayonet type light bulb
40 pins extending from base of bayonet type light bulb
42 contact terminals on bayonet type light bulb
44 underside of bayonet type light bulb
46 bayonet type socket
48 base of bayonet type socket
50 skirt extending from base of bayonet type socket
52 pin receiving recesses in skirt of bayonet type socket
54 first embodiment of light bulb-socket adapter of the present invention
56 bayonet type bulb receiving section
58 Edison type bulb connector section
60 nonconductive barrier layer
62 base of bayonet type bulb receiving section
64 skirt extending from base of bayonet type bulb receiving section
66 bulb receiving pool of bayonet type bulb receiving section
68 pin receiving recesses in skirt of bayonet type bulb receiving section
70 first contact on base of bayonet type bulb receiving section
71 second contact on base of bayonet type bulb receiving section
72 base of Edison type bulb connector section
74 thread spiraling around skirt of Edison type bulb connector section
76 contact on Edison type bulb connector section
78 underside of Edison type bulb connector section
80 first wire connecting first contact on base of bayonet type bulb receiving section to base of Edison type bulb connector section
82 second wire connecting second contact on base of bayonet type bulb receiving section to contact of Edison type bulb connector section
84 second embodiment of light bulb-socket adapter of the present invention
86 Edison type bulb receiving section
88 bayonet type bulb connector section
90 nonconductive barrier layer
92 base of Edison type bulb receiving section
94 skirt extending from base of Edison type bulb receiving section
96 bulb receiving pool of Edison type bulb receiving section
98 thread spiraling around skirt of Edison type bulb receiving section
100 contact within bulb receiving pool of Edison type bulb receiving section
102 base of bayonet type bulb connector section
104 pins extending from base of bayonet type bulb connector section
106 first contact terminal of bayonet type bulb connector section
108 second contact terminal of bayonet type bulb connector section
110 underside of base of bayonet type bulb connector section
112 first wire connecting first contact on base of bayonet type bulb connector section to base of Edison type bulb receiving section
114 second wire connecting second contact on base of bayonet type bulb connector section to contact of Edison type bulb receiving section

DETAILED DESCRIPTION OF THE PREFERRED EMBODIMENT

Figure 2:
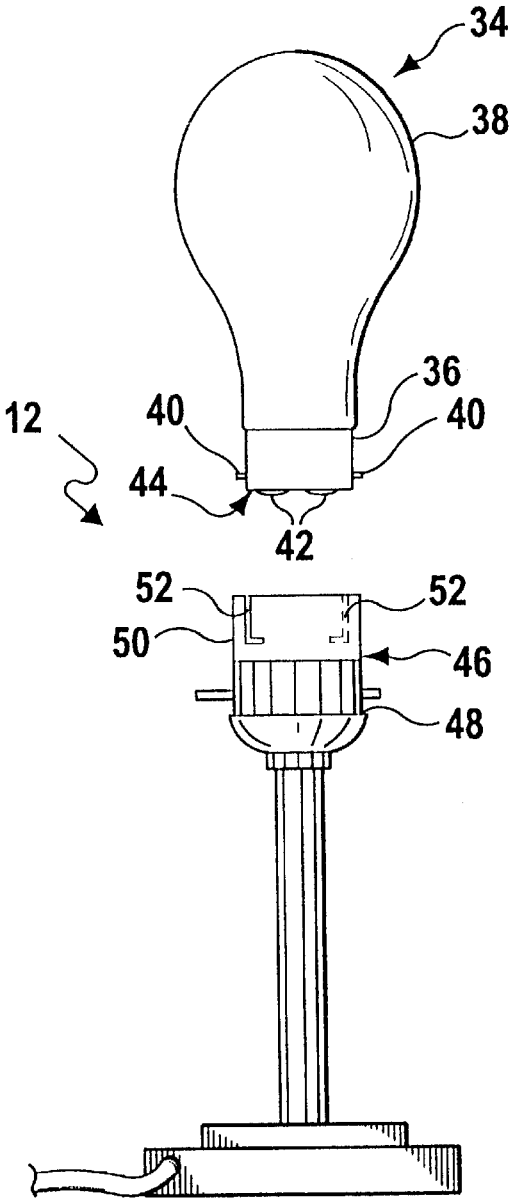
FIG 2 (PRIOR ART)
FIG. 2 is a front elevational expanded view of a typical bayonet type lamp and light bulb.

Turning now descriptively to the drawings, in which similar reference characters denote similar elements throughout the several views, FIGS. 1 and 2 respectively illustrate a conventional Edison type bulb and socket arrangement indicated generally by the numeral 10 and a conventional bayonet type bulb and socket arrangement indicated generally by the numeral 12.

A conventional Edison type bulb 14 including a conductive base portion 16 extending from a bulb portion 18 is illustrated in FIG. 1. The conductive base portion 16 includes a thread 20 spiraling therearound and a single contact terminal 22 extending from an underside 24 thereof.

The conventional Edison type socket 26 includes a base section 28 having a skirt 30 extending therefrom to form a bulb receiving pool. A thread 32 spirals around an inner side of the skirt 30 for mating with the thread 20 spiraling around the conductive base portion 16 of the Edison type bulb 14. When the conductive base portion 16 of the Edison type bulb 14 is inserted into the Edison type socket 26 and rotated in a clockwise direction the thread 20 is caused to mate with the thread 32 spiraling around the skirt 30 of the socket 26 and the conductive base portion 16 of the bulb 14 is received within the bulb receiving pool. When the conductive base portion 16 is completely received within the bulb receiving pool, the contact terminal 22 on the underside 24 of the conductive base portion 16 of the bulb 14 is placed in contact with a contact terminal (not shown) within the bulb receiving pool and the conductive base portion 16 of the Edison type bulb 14 is in contact with an inner side of the skirt 30 to complete the circuit. This connects a filament within the Edison type light bulb 14 to the power supply allowing power to be supplied through a filament within the bulb 18 to generate light.

A conventional bayonet type bulb 34 includes a base portion 36 extending from a bulb portion 38 thereof. The base portion 36 includes a pair of pins 40 extending therefrom and a pair of contact terminals 42 extending from an underside 44 thereof. The conventional bayonet type socket 46 includes a nonconductive base section 48 having a skirt 50 extending therefrom to form a bulb receiving pool. A pair of pin receiving L-shaped recesses 52 extend through opposing sides of the skirt 50, each recess 52 being positioned to receive a respective one of the pair of pins 40 extending from the base portion 36 of the bayonet type light bulb 34. When the base portion 36 of the bayonet type light bulb 34 is completely inserted into the bulb receiving pool whereby the pair of pins 40 are received by their respective L-shaped recess 52, the bayonet type light bayonet type light bulb 34 is turned in a counterclockwise direction causing the pair of pins 40 to be seated in a horizontal portion of their respective L-shaped recess 52 and the pair of contact terminals 42 on the underside 44 of the base portion 36 of the bayonet type light bulb 34 to contact with a pair of contacts (not shown) within the bulb receiving pool to complete the circuit. This connects a filament within the bayonet type light bulb 34 to the power supply allowing power to be supplied through a filament within the bulb 18 to generate light.

Figure 3:
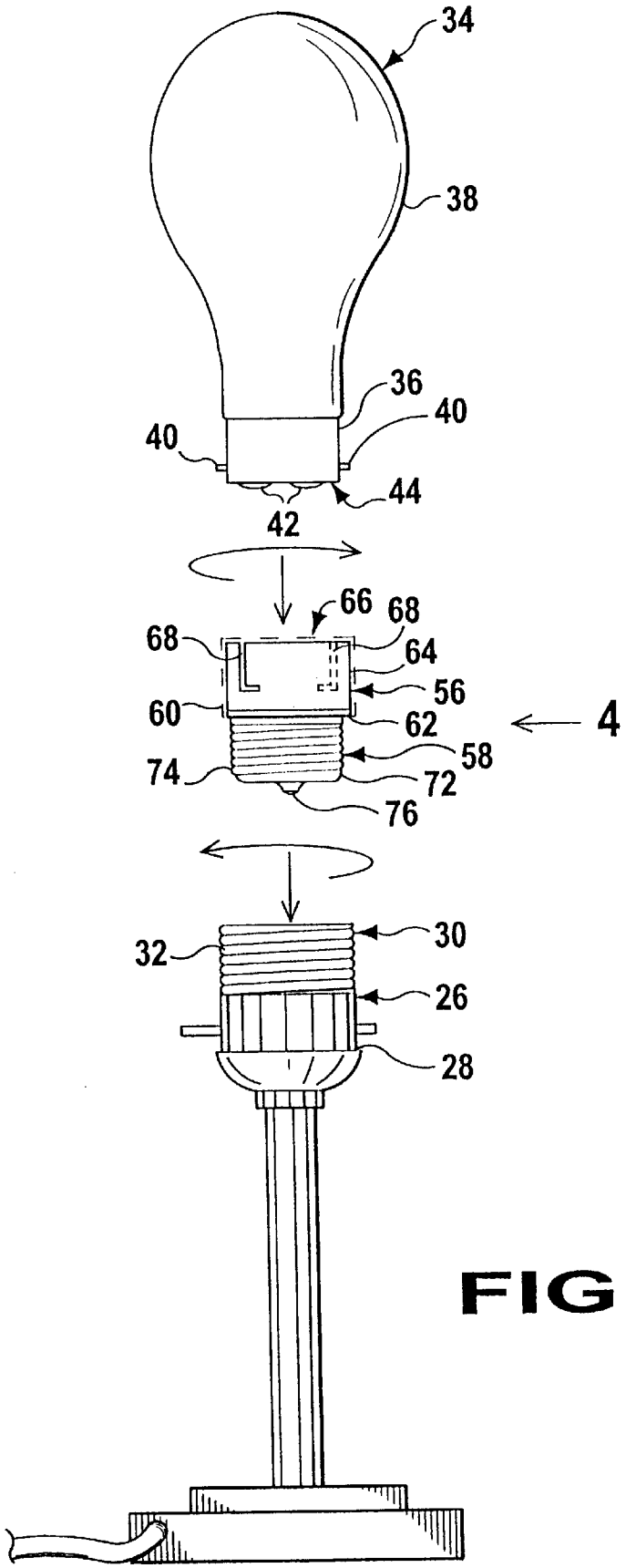
FIG. 3 is a front elevational expanded view of a typical Edison type lamp and bayonet type light bulb connected using the light bulb-socket adapter of the present invention.
Figure 4:
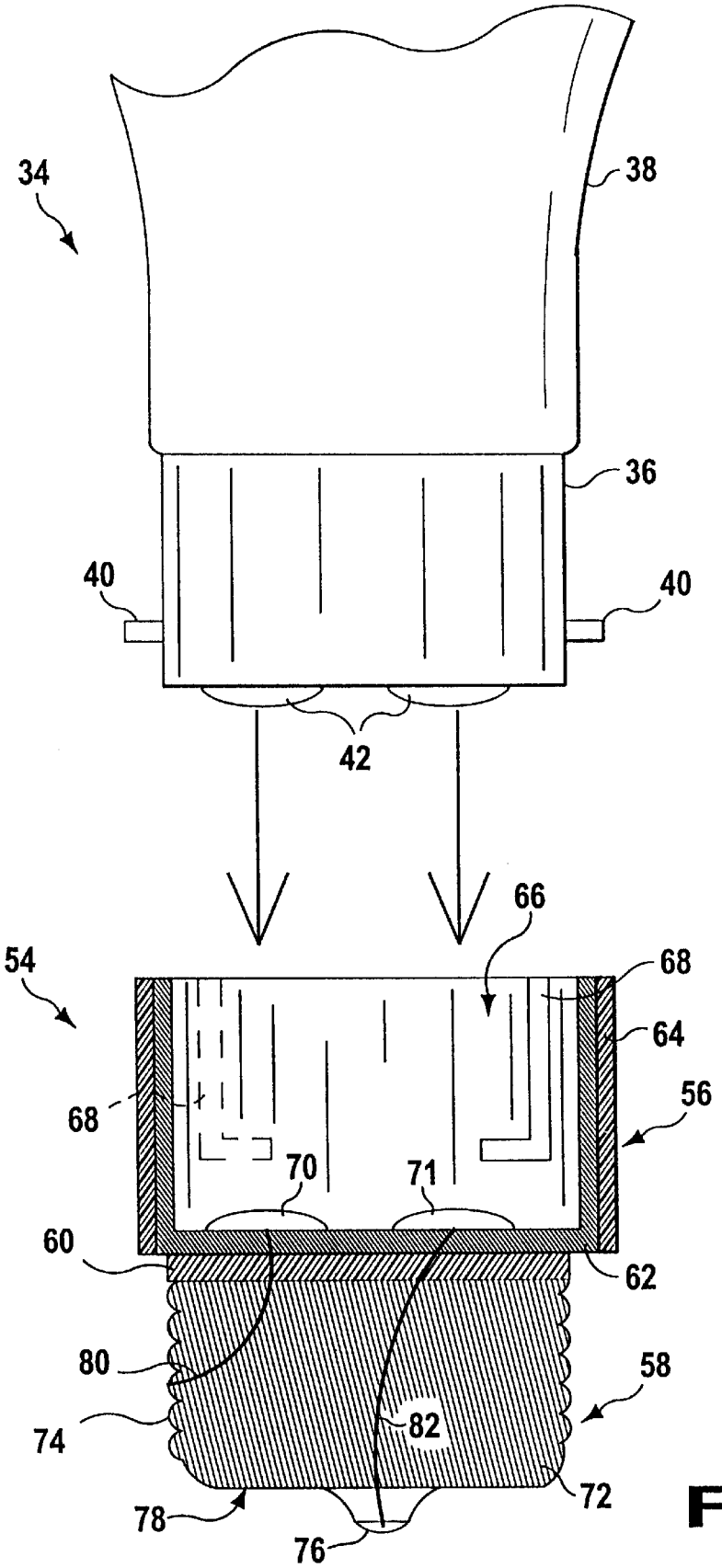
FIG. 4 is an exploded side perspective view taken in the direction of the arrow labeled 4 of FIG. 3 of the base of a bayonet type light bulb for connection to the light bulb-socket adapter of the present invention.

FIGS. 3 and 4 illustrate a first embodiment of the light bulb-socket adapter of the present invention indicated generally by the numeral 54 for connecting a bayonet type bulb 34 to an Edison type socket 26. Identical reference numerals are used in FIGS. 3 and 4 to indicate similar elements previously discussed with reference to FIGS. 1 and 2. Further detailed discussion of such elements is therefore not necessary. The light bulb-socket adapter 54 includes a bayonet type bulb receiving section 56, an Edison type bulb connector section 58 and a nonconductive barrier layer 60 positioned between and connceted to both the bayonet type bulb receiving section 56 and Edison type bulb connector section 58.

The bayonet type bulb receiving section 56 includes a base 62 and a skirt 64 extending therefrom to form a bulb receiving pool 66. A pair of pin receiving L-shaped recesses 68 extend through opposing sides of the skirt 64, each recess 68 being positioned to receive a respective one of the pair of pins 40 extending from the base 36 of the bayonet type light bulb 34. Positioned on the base 62 of the bayonet type bulb receiving section 56 and within the bulb receiving pool 66 are first and second contacts 70 and 71 respectively.

The Edison type bulb connector section 58 includes a conductive base 72 extending from the nonconductive barrier layer 60. The conductive base 72 includes a thread 74 extending therearound and a single contact terminal 76 extending from an underside 78 thereof. The thread 74 is for mating with the thread 32 spiraling around the skirt 30 of the Edison type socket 26 whereby the conductive base 72 of the Edison type bulb connector 58 may be received within the bulb receiving pool of an Edison type socket 26. Extending from the first contact terminal 70 of the bayonet type bulb receiving section 56 and through the nonconductive barrier layer 60 to contact the conductive base 72 of the Edison type bulb connector section 58 is a first conductive wire 80 and extending from the second contact terminal 71 of the bayonet type bulb receiving section 56 and through the nonconductive barrier layer 60 to contact the single contact terminal 76 of the Edison type bulb connector section 58 is a second conductive wire 82. The nonconductive barrier layer 62 acts to isolate the bayonet type bulb receiving section 56 from the Edison type bulb connector section 58 whereby the only connection between the bayonet type bulb receiving section 56, an Edison type bulb connector section 58 is through the first and second wires 80 and 82.

Figure 5:
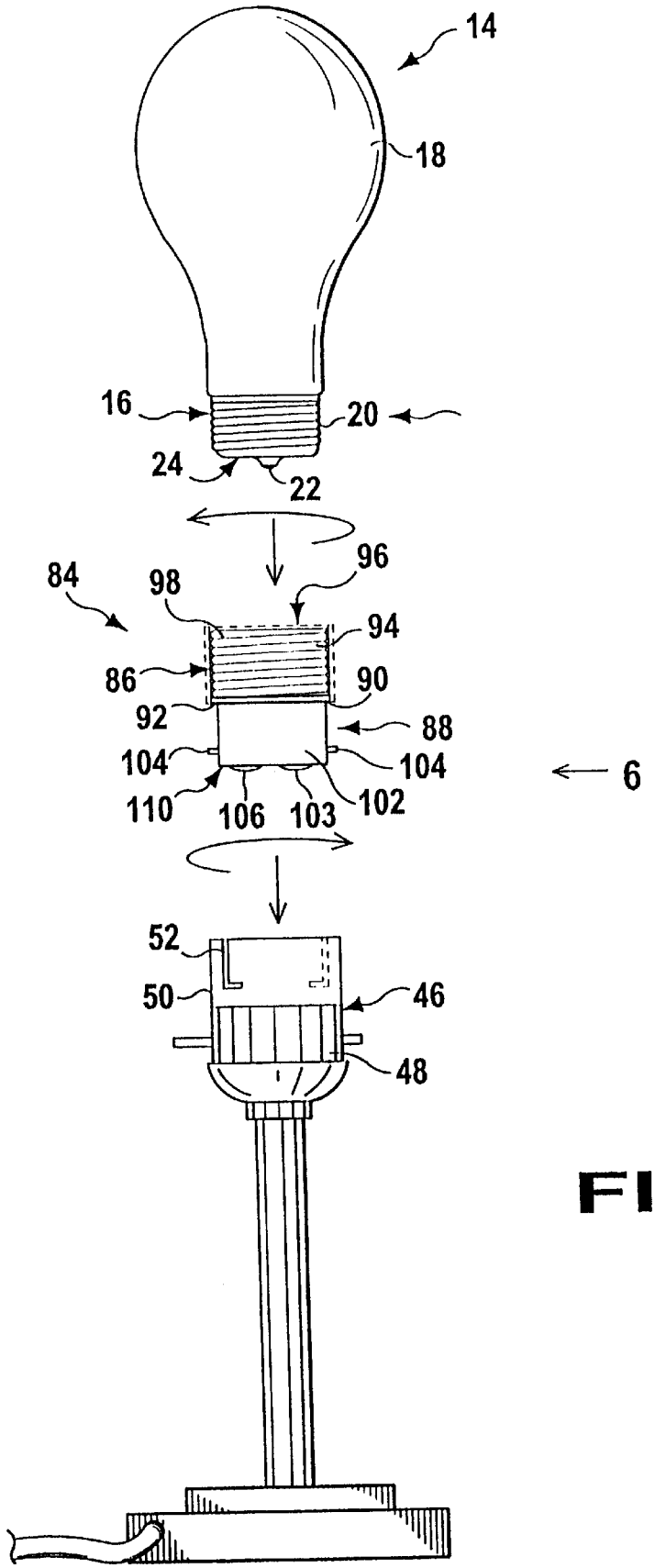
FIG. 5 is a front elevational expanded view of a typical bayonet type lamp and Edison type light bulb connected using the light bulb-socket adapter of the present invention.
Figure 6:
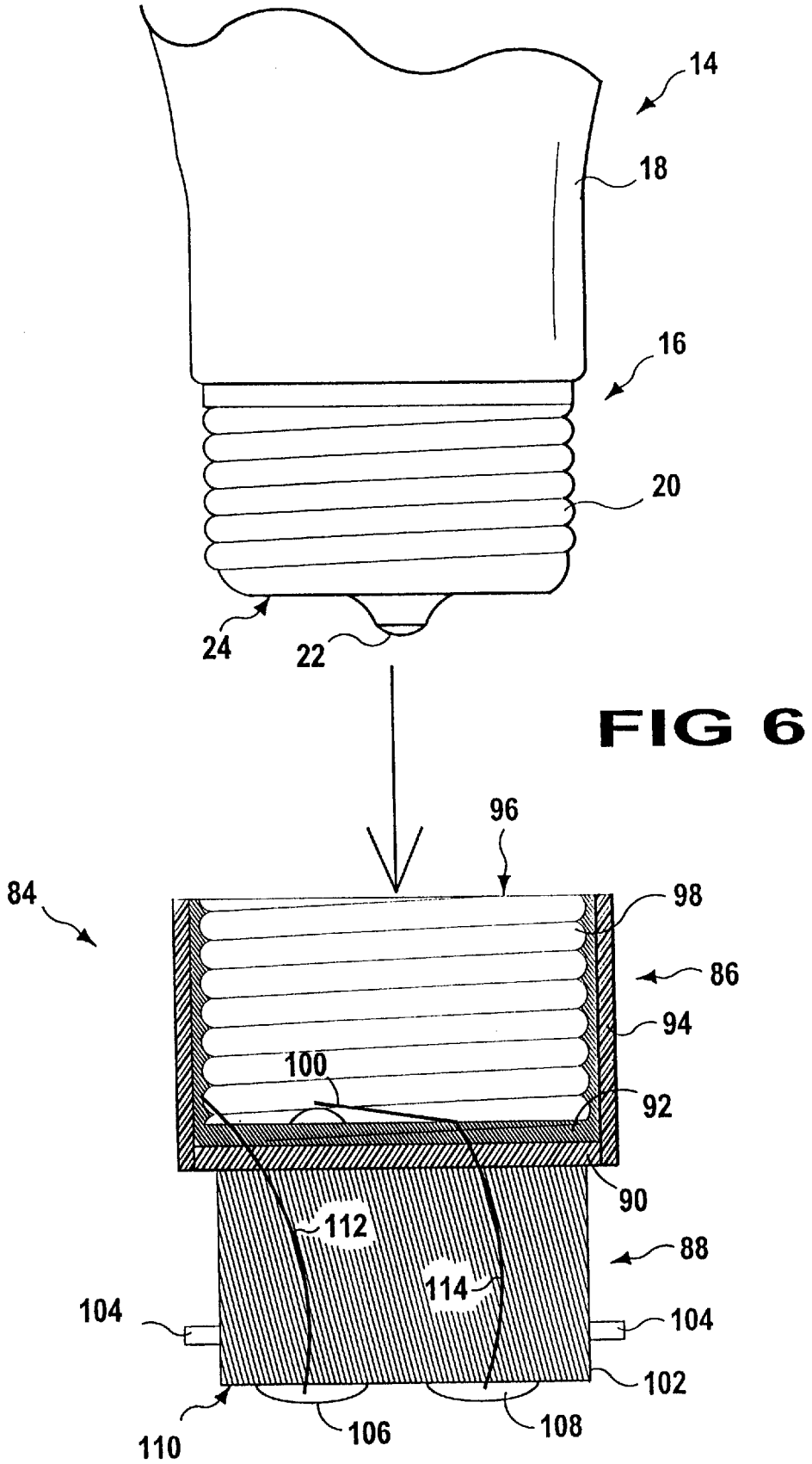
FIG. 6 is an exploded side perspective view taken in the direction of the arrow labeled 6 of FIG. 5 of the base of an Edison type light bulb for connection to the light bulb-socket adapter of the present invention.

FIGS. 5 and 6 illustrate a second embodiment of the light bulb-socket adapter of the present invention indicated generally by the numeral 84 for connecting an Edison type light bulb 14 to a bayonet type socket 26. Identical reference numerals are used in FIGS. 5 and 6 to indicate similar elements previously discussed with reference to FIGS. 1 and 2. Further detailed discussion of such elements is therefore not necessary. The light bulb-socket adapter 84 includes an Edison type bulb receiving section 86, a bayonet type bulb connector section 88 and a nonconductive barrier layer 90 positioned between and connected to both the bayonet type bulb receiving section 86 and Edison type bulb connector section 88.

The Edison type bulb connector section 86 includes a base 92 and a skirt 94 extending therefrom to form a bulb receiving pool 96. A thread 98 spirals around an inner side of the skirt 94 for mating with the thread 20 spiraling around the base portion 16 of the Edison type light bulb 14. A contact terminal 100 is positioned on the base 16 of the Edison type bulb connector section 86 and within the bulb receiving pool 96. When the base portion 16 of the bulb 14 is inserted into the Edison type bulb connector section 86 and the bulb 14 is rotated in a clockwise direction, the thread 20 spiraling around the base portion 16 of the bulb 14 is caused to mate with the thread 98 spiraling around the skirt 94 of the Edison type bulb connector section 86 whereby the base 16 of the bulb 14 is received within the bulb receiving pool 96. When the base 16 is completely received by the bulb receiving pool 96, the contact terminal 22 on the underside 24 of the base 16 of the bulb 14 is placed in contact with the contact terminal 100 within the bulb receiving pool 96 and the base 16 of the Edison type bulb 14 is in contact with an inner side of the skirt 96.

The bayonet type bulb connector section 88 includes a conductive base 102 and a pair of pins 104 extending therefrom. First and second contact terminals 106 and 108 respectively extend from an underside 110 of the conductive base 102. The pair of pins 104 extending from the conductive base 102 are received by respective ones of the L-shaped recesses 52 in the bayonet type socket 46. When the base 36 of the bulb 34 is completely inserted into the bulb receiving pool the pair of pins 104 are received by their respective L-shaped recess 52. The light bulb-socket adapter 84 is then turned in a counterclockwise direction causing the pair of pins 104 to be seated in a horizontal portion of their respective L-shaped recess 52 and the pair of contact terminals 106 and 108 on the underside 110 of the base 102 of the bayonet type bulb connector 88 to contact a pair of contact terminals (not shown) within the bulb receiving pool.

Extending from the first contact terminal 106 on the underside 110 of the base 102 of the bayonet type bulb receiving section 88 and through the nonconductive barrier layer 90 to contact the conductive base 94 of the Edison type bulb receiving section 86 is a first conductive wire 112 and extending from the second contact 108 on the underside 110 of the base 102 of the bayonet type bulb receiving section 88 and through the nonconductive barrier layer 90 to contact the contact terminal 100 of the Edison type bulb receiving section 86 is a second conductive wire 114. The nonconductive barrier layer 90 acts to isolate the Edison type bulb receiving section 86 from the bayonet type bulb connector 88 whereby the only connection between the Edison type bulb receiving section 86 and bayonet type bulb connector section 88 is through the first and second wires 112 and 114.

The size of the bayonet type receiving section 56 and Edison type connector section 58 of the light bulb-socket adapter 54 may be adjusted to fit any size bayonet type light bulb and Edison type socket thereby providing the flexibility to mix and match any size bayonet type light bulb and Edison type socket. Likewise the size of the Edison type receiving section 86 and bayonet type connector section 88 of the light bulb-socket adapter 84 may be adjusted to fit any size Edison type light bulb and bayonet type socket thereby providing the flexibility to mix and match any size Edison type light bulb and bayonet type socket.

The operation of the light bulb-socket adapter 54 will now be described with reference to FIGS. 3 and 4. In operation, the base 72 of the Edison type connector section 58 of the light bulb-socket adapter 54 is inserted into the bulb receiving pool of an Edison type socket 26 of the same size and turned in a clockwise direction. This causes the thread 74 spiraling around the base 72 of the Edison type connector section 58 to engage and mate with the thread 32 spiraling around the base of the Edison type socket 26. When the threads 74 and 32 are completely mated whereby the base 72 is fully received within the bulb receiving pool, the contact terminal 76 is in contact with the contact terminal within the bulb receiving pool.

A bayonet type light bulb 34 sized to fit within the light bulb-socket adapter 54 is then positioned such that the pins 40 extending from the base 36 of the bayonet type light bulb 34 are each received by respective ones of the L-shaped recesses 68 in the skirt 64 of the bayonet type bulb receiving section 56. This allows the base 36 of the bayonet type light bulb 34 to be received within the bulb receiving pool 66 of the bayonet type bulb receiving section 56. The bayonet type light bulb 34 is then turned in a counterclockwise direction causing the pins 40 extending from the base 36 of the bayonet type light bulb 34 to be received by the horizontal section of their respective L-shaped recess 68. The two contact terminals 42 on the underside 44 of the base 36 are now placed in contact with the first and second contact terminals 70 and 71 within the bulb receiving pool 66.

As the first contact terminal 70 within the bulb receiving pool 66 is connected by the first wire 80 to the conductive base 72 of the Edison type connector section 58 and the second contact terminal 71 within the bulb receiving pool 66 is connected by the second wire 82 to the contact terminal 76, the bayonet type light bulb 34 is now connected to the Edison type socket and can receive power via the first and second wires 80 and 82 to produce light.

The operation of the light bulb-socket adapter 84 will now be described with reference to FIGS. 5 and 6. In operation, the base 102 of the bayonet type connector section 88 of the light bulb-socket adapter 84 is inserted into the bulb receiving pool of a bayonet type socket 46 of the same size such that the pins 104 extending from the base 102 of the bayonet type connector section 88 are each received by respective ones of the L-shaped recesses 52 in the skirt 50 of the bayonet type socket 46. This allows the base 102 of the bayonet type connector section 88 to be received within the bulb receiving pool of the bayonet type socket 46. The bayonet type connector section 88 is then turned in a counterclockwise direction causing the pins 104 extending from the base 102 of the bayonet type light connector section 88 to be received by the horizontal section of their respective L-shaped recess 52. The first and second contact terminals 106 and 108 on the underside 110 of the base 102 are now placed in contact with the two contact terminals within the bulb receiving pool.

An Edison type light bulb 14 sized to fit within the light bulb-socket adapter 86 is then positioned so that the base 16 of the Edison type light bulb 14 is inserted into the bulb receiving pool 96 of the Edison type bulb receiving section 86 and turned in a clockwise direction. This causes the thread 98 spiraling around the skirt 94 of the Edison type bulb receiving section 86 to engage and mate with the thread 20 spiraling around the base of the Edison type light bulb 14. When the threads 98 and 3220 are completely mated whereby the conductive base 16 is fully received within the bulb receiving pool 96, the contact terminal 22 is in contact with the contact terminal 100 within the bulb receiving pool 66.

As the first contact terminal 106 is connected by the first wire 112 to the conductive base or conductive skirt 92 or 94 of the Edison type bulb receiving section 86 and the second contact terminal 108 is connected by the second wire 114 to the contact terminal 100 within the bulb receiving pool 96, the Edison type light bulb 14 is now connected to the bayonet type socket 46 and can receive power via the first and second wires 112 and 114 to produce light.

From the above description it can be seen that the light bulb-socket adapter of the present invention is able to overcome the shortcomings of prior art devices by providing a light bulb-socket adapter which is able to adapt an Edison type light bulb to fit into a bayonet cap base to adapt a bayonet type light bulb to fit into an Edison type cap base. The light bulb-socket adapter is also able to adapt a light bulb of any size for connection to a socket of any size and includes a separator section preventing the base of the bulb from contacting the base of the socket. Furthermore, the light bulb-socket adapter of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A light bulb-socket adapter for connecting a bayonet type light bulb to an Edison type socket, said light bulb-socket adapter comprising:

a) an Edison type connector section including means for connecting to the Edison type socket and a connection terminal extending from said means for connecting, said means for connecting being made of conductive material;

b) a bayonet type bulb receiving section including means for receiving a base section of the bayonet type bulb, and first and second contact terminals positioned within said means for receiving;

c) a nonconductive barrier layer connected between said Edison type connector section and bayonet type bulb receiving section for isolating said bayonet type bulb receiving section from said Edison type connector section;

d) a first connection unlooped wire connecting said means for connecting to said first connection terminal of said bayonet type bulb receiving section through said nonconductive barrier layer;

e) a second connection unlooped wire laterally spaced from said first connection wire connecting said contact terminal of said Edison type connector section to said second connection terminal of said bayonet type bulb receiving section through said nonconductive barrier layer, wherein said contact terminal is caused to contact a terminal on the Edison type socket when said means for connecting is positioned within the Edison type socket and said first and second connection terminals are caused to contact respective first and second connection terminals on the bayonet type bulb when the bayonet type bulb is received by said means for receiving causing said first connection terminal of the bayonet type bulb to contact the base of the Edison type socket via said first connecting wire and the second connection terminal of the bayonet type bulb to contact the contact terminal of said Edison type socket via said second connecting wire; and f) said means for connecting includes a base portion and a thread spiraling within the Edison type socket.

2. A light bulb-socket adapter tor connecting an Edison type light bulb to a bayonet type socket, said light bulb-socket adapter comprising:

a) a bayonet type connector section including means for connecting to the bayonet type socket and first and second connection terminals extending from said means for connecting;

b) an Edison type bulb receiving section including means for receiving a base section of the Edison type bulb, and a contact terminal positioned within said means for receiving;

c) a nonconductive barrier layer connected between said bayonet type connector section and Edison type bulb receiving section isolating said sections from each other;

d) a first connection unlooped wire passing through said nonconductive barrier layer and connecting said first connection terminal of said bayonet type connector section to said means for receiving;

e) a second connection unlooped wire laterally spaced from said first connection wire passing through said nonconductive barrier layer, and connecting said second connection terminal of said bayonet type connector section to said contact terminal of said Edison type bulb receiving section, wherein said first and second connection terminals are caused to contact respective first and second connection terminals within the bayonet type socket when said means for connecting is positioned within the bayonet type socket and said first contact terminal is caused to contact a respective first contact terminal of the Edison type bulb when the Edison type bulb is received by said means for receiving causing the first contact terminal of the bayonet type socket to contact the Edison type bulb via said first connecting wire and the second contact terminal of the bayonet type socket to contact the contact terminal of the Edison type bulb via said second connecting wire; and f) said means for receiving includes a base and a skirt extending from said base, said skirt including a thread spiraling therearound for mating with a thread spiraling around the Edison type bulb.

* * * * *